US006178665B1

(12) United States Patent
MacPhail et al.

(10) Patent No.: US 6,178,665 B1
(45) Date of Patent: Jan. 30, 2001

(54) FIT AND SUPPORT SYSTEM FOR THE FOOT

(75) Inventors: David M. MacPhail, Whistler; Blaine Hoshizaki, Lasalle; Steve Podborski, Whistler, all of (CA)

(73) Assignee: Macpod Enterprises Ltd., Willowdale (CA)

( * ) Notice: Under 35 U.S.C. 154(b), the term of this patent shall be extended for 0 days.

(21) Appl. No.: 08/873,870

(22) Filed: Jun. 12, 1997

(51) Int. Cl.[7] ..... A43B 5/04
(52) U.S. Cl. ..... 36/117.9; 36/117.7; 36/117.1
(58) Field of Search ..... 36/117.1, 117.7, 36/117.9, 88, 69, 68, 71

(56) References Cited

U.S. PATENT DOCUMENTS

| | | |
|---|---|---|
| 1,549,382 | 8/1925 | Riddell . |
| 2,444,428 | 7/1948 | Carrier . |
| 3,169,325 | 2/1965 | Fesl . |
| 3,182,341 | 5/1965 | Rieffle . |
| 3,203,016 | 8/1965 | Miller et al. . |
| 3,313,046 | 4/1967 | Werner et al. . |
| 3,325,920 | 6/1967 | Werner et al. . |
| 3,372,495 | 3/1968 | Finn . |
| 3,374,561 | 3/1968 | Werner et al. . |
| 3,431,658 | 3/1969 | Finn . |
| 3,543,421 | 12/1970 | Ader . |
| 3,599,351 | 8/1971 | Check . |
| 3,609,887 | 10/1971 | Hickmann et al. . |

(List continued on next page.)

FOREIGN PATENT DOCUMENTS

| | | |
|---|---|---|
| 248917 | 8/1966 | (AT) . |
| 356541 | 5/1980 | (AT) . |
| 764657 | 8/1967 | (CA) . |
| 806885 | 2/1969 | (CA) . |
| 807888 | 3/1969 | (CA) . |
| 811930 | 5/1969 | (CA) . |
| 1167638 | 5/1984 | (CA) . |
| 1194298 | 10/1985 | (CA) . |
| 626793 | 12/1981 | (CH) . |
| 95964 | 1/1898 | (DE) . |
| 1963342 | 12/1969 | (DE) . |
| 1959022 | 6/1970 | (DE) . |
| 1962632 | 6/1971 | (DE) . |
| 2650174 | 5/1977 | (DE) . |

(List continued on next page.)

OTHER PUBLICATIONS

Lito Teiada–Flores, "The Edge Effect", Mar. 1991, *94 Skiing*.

Ron LeMaster, "The Secrets of Power Edging", Jan. 1990, *Snow Country*.

*Primary Examiner*—Ted Kavanaugh
(74) *Attorney, Agent, or Firm*—Bereskin & Parr

(57) ABSTRACT

The present invention relates to a forefoot/midfoot compression member for a footwear device. The compression member comprises an instep counter and an arm mechanism for rigidly supporting the instep counter. The arm mechanism is disposed along only one of the medial or lateral aspects of the footwear device. The arm mechanism is adjustable to move the instep counter to a desired position and a retention mechanism is provided to retain the arm mechanism in the desired position. In another aspect, the invention relates to a retention member for a liner for a footwear device. The retention member includes a plate that mounts to the liner. A post extends from the plate through a bore defined in a wall for the footwear device where it is secured with a fastener. In another aspect, the invention relates to a retention member for an article of footwear within a footwear device. The retention member comprises a lug protruding from a base for the footwear device for mating with a corresponding profile defined in the sole of the article of footwear.

20 Claims, 9 Drawing Sheets

U.S. PATENT DOCUMENTS

| | | | |
|---|---|---|---|
| 3,613,273 | 10/1971 | Marquis . | |
| 3,619,914 | 11/1971 | Hanson et al. . | |
| 3,657,827 | 4/1972 | Rieker . | |
| 3,812,602 | 5/1974 | Gertsch et al. . | |
| 3,849,914 | 11/1974 | Bertelé . | |
| 3,858,337 | 1/1975 | Vogel . | |
| 3,883,964 | 5/1975 | Check . | |
| 4,060,256 | 11/1977 | Collombin et al. . | |
| 4,074,446 | 2/1978 | Eisenberg . | |
| 4,083,128 | 4/1978 | Rossman . | |
| 4,085,528 | 4/1978 | Delery . | |
| 4,137,654 | 2/1979 | Hlavac . | |
| 4,141,570 | 2/1979 | Sudmeier . | |
| 4,144,659 | 3/1979 | Eisenberg . | |
| 4,179,827 | 12/1979 | Vaccari . | |
| 4,192,087 | 3/1980 | Salomon | 36/119 |
| 4,199,879 | 4/1980 | Wegeng . | |
| 4,236,725 | 12/1980 | Bataille . | |
| 4,253,251 | 3/1981 | Salomon . | |
| 4,253,252 | 3/1981 | Eisenberg . | |
| 4,391,049 | 7/1983 | Parisotto . | |
| 4,406,073 | 9/1983 | Spademan . | |
| 4,454,663 | 6/1984 | Graillat et al. . | |
| 4,501,078 | 2/1985 | Kopp . | |
| 4,505,494 | 3/1985 | Gertsch . | |
| 4,506,460 | 3/1985 | Rudy . | |
| 4,513,520 | 4/1985 | Koch . | |
| 4,534,122 | 8/1985 | MacPhail . | |
| 4,581,831 | 4/1986 | Kirsch . | |
| 4,611,414 | 9/1986 | Vogel . | |
| 4,615,127 | 10/1986 | Delery . | |
| 4,620,378 | 11/1986 | Sartor . | |
| 4,670,999 | 6/1987 | Olivieri . | |
| 4,698,922 | 10/1987 | Sartor . | |
| 4,709,491 | 12/1987 | Morell et al. . | |
| 4,718,181 | 1/1988 | Olivieri . | |
| 4,719,926 | 1/1988 | Nelson . | |
| 4,720,926 | 1/1988 | Marxer . | |
| 4,724,626 | 2/1988 | Baggio . | |
| 4,772,041 | 9/1988 | Klosterman . | |
| 4,776,111 | 10/1988 | Crowley . | |
| 4,791,736 | 12/1988 | Phillips . | |
| 4,800,659 | 1/1989 | Marega . | |
| 4,839,973 | 6/1989 | Dodge . | |
| 4,866,861 | 9/1989 | Noone . | |
| 4,867,470 | 9/1989 | Clark . | |
| 4,914,839 | 4/1990 | Paris et al. . | |
| 4,922,634 | 5/1990 | Seidel . | |
| 4,937,951 | 7/1990 | Loecker . | |
| 4,977,692 | 12/1990 | Iwama et al. . | |
| 5,001,851 | 3/1991 | Baggio et al. . | |
| 5,029,890 | 7/1991 | Pfaffenbichler et al. . | |
| 5,033,210 | 7/1991 | Dodge et al. . | |
| 5,054,807 | 10/1991 | Fauvet . | |
| 5,092,621 | 3/1992 | Horn . | |
| 5,094,470 | 3/1992 | Riedel . | |
| 5,172,924 | 12/1992 | Barci . | |
| 5,213,356 | 5/1993 | Rohrmoser . | |
| 5,265,350 | 11/1993 | MacPhail . | |
| 5,279,053 | 1/1994 | Pallatin et al. | 36/117 |
| 5,286,051 | 2/1994 | Scherübl . | |
| 5,293,702 | 3/1994 | Miyoshi et al. . | |
| 5,299,823 | 4/1994 | Glaser . | |
| 5,347,731 | 9/1994 | Iwama . | |
| 5,459,949 | 10/1995 | MacPhail . | |
| 5,544,909 | 8/1996 | Laughlin et al. . | |

FOREIGN PATENT DOCUMENTS

| | | | |
|---|---|---|---|
| 8103473 | 7/1981 | (DE) . | |
| 3045928 | 9/1981 | (DE) . | |
| 31 15618 A1 | 3/1982 | (DE) | A63C/9/20 |
| 3132993 | 4/1982 | (DE) . | |
| 8133090 | 4/1982 | (DE) . | |
| 3044052 | 6/1982 | (DE) . | |
| 84 16 842 | 8/1984 | (DE) | A43B/5/04 |
| 8416842 | 8/1984 | (DE) . | |
| 3504002 | 8/1986 | (DE) . | |
| 3540428 | 11/1986 | (DE) . | |
| 3636496 | 4/1988 | (DE) . | |
| 4138801 | 5/1993 | (DE) . | |
| 0048965 | 4/1982 | (EP) . | |
| 0 073 991 | 3/1983 | (EP) | A43B/5/04 |
| 0073991 | 3/1983 | (EP) . | |
| 0 111 822 | 6/1984 | (EP) | A43B/5/04 |
| 0111822 | 6/1984 | (EP) . | |
| 0134034 | 3/1985 | (EP) . | |
| 0150801 | 8/1985 | (EP) . | |
| 0183182 | 6/1986 | (EP) . | |
| 0205128 | 12/1986 | (EP) . | |
| 0240619 | 10/1987 | (EP) . | |
| 0252517 | 1/1988 | (EP) . | |
| 0302309 | 2/1989 | (EP) . | |
| 0337905 | 10/1989 | (EP) . | |
| 0371958 | 6/1990 | (EP) . | |
| 0 120 293 | 10/1994 | (EP) | A43B/5/04 |
| 0707872 | 4/1996 | (EP) . | |
| 1307982 | 9/1962 | (FR) . | |
| 1322387 | 3/1963 | (FR) . | |
| 1387319 | 12/1964 | (FR) . | |
| 481 593 | 11/1969 | (FR) | A43B/5/04 |
| 2063622 | 7/1971 | (FR) . | |
| 2215784 | 8/1974 | (FR) . | |
| 2230155 | 12/1974 | (FR) . | |
| 2261720 | 9/1975 | (FR) . | |
| 2381483 | 9/1978 | (FR) . | |
| 2496423 | 6/1982 | (FR) . | |
| 2509586 | 1/1983 | (FR) . | |
| 2608903 | 12/1986 | (FR) . | |
| 2608384 | 6/1988 | (FR) . | |
| 2682571 | 4/1993 | (FR) . | |
| 496056 | 11/1938 | (GB) . | |
| 530106 | 7/1955 | (IT) . | |
| 23658 | 11/1984 | (IT) . | |
| WO 79/00886 | 11/1979 | (WO) . | |
| WO 87/05473 | 9/1987 | (WO) . | |
| WO 90/12515 | 11/1990 | (WO) . | |
| WO 95/14400 | 6/1995 | (WO) . | |
| WO 96/37270 | 11/1996 | (WO) . | |

FIT AND SUPPORT SYSTEM FOR THE FOOT

FIELD OF THE INVENTION

The present invention relates to fit and support systems for the foot and in particular to improvements thereto relating to forefoot/midfoot compression members and liner or shoe retention members.

BACKGROUND OF THE INVENTION

U.S. Pat. No. 5,265,350 discloses a dynamic coupling means for connecting the foot of a user to mediums such as skis, skates and the like wherein an instep counter is pivotally mounted on a rigid arch-like structure connected to a rigid base on the medial and lateral aspects of the foot. The instep counter is brought to bear on the dorsum of the user's foot with a threaded adjustment means. While the arch-like structure is efficient insofar as producing the desired effect it has several limitations insofar as convenient operation for the user and application to consumer products. These limitations include such things as excessive bulk, difficult entry of a user's foot and insertion and removal of shoes and liner structures when the invention is applied to mediums such as inline and ice skates. Limitations also are present insofar as the location of the connection points of the rigid arch with the base structure of the technology particularly as it relates to the lateral aspect where it is desirable to minimize the introduction of structures in the forefoot which could interfere with the natural spreading of the heads of the metatarsals.

The present invention overcomes the above limitations by a forefoot/midfoot compression member whose connections means with the base of the footwear resides on one aspect of the user's foot.

The dynamic fit system for the foot disclosed in U.S. Pat. No. 5,265,350 provides structures which maintain the position of discrete elements of the foot in place on the rigid base even when the device is used in conjunction with a liner system. However problems arise when a liner is removable from the dynamic fit system or when the footwear is employed with it. Without the action of the instep counter pressing on the user's foot within the liner there is no influence acting to maintain the position of these elements especially during ingress and egress of the user's foot. When street shoes are employed with the device a problem exists in ensuring that the sole of the footwear is correctly positioned on the rigid base prior to the engagement of the instep counter. In the use of such footwear a further problem arises relating to the coefficient of friction between the sole of the footwear and the rigid base of the device. It is desirable to have a sufficient coefficient of friction between these two elements to reduce laterally acting shear forces acting between the rigid base and the instep counter.

The present invention overcomes the above limitations by a retention member for securing the liner or footwear within the footwear device.

SUMMARY OF THE INVENTION

In one aspect the invention provides a footwear device comprising:

a rigid base for supporting the foot of a user thereon;

an instep counter for engaging the dorsum of the users foot;

an arm assembly operatively connecting said instep counter to said base of said footwear device to rigidly support said instep counter in a position for exerting a force on the user's foot, said arm assembly being disposed along only one of the medial or lateral aspects of said footwear device, wherein said arm assembly comprises a rigid arm and an arm base, said rigid arm having a first portion that is connected to said instep counter and a second portion that is adjustably connected to said arm base, said arm base being rigidly connected to said base of said footwear device;

an adjustment assembly located on said arm assembly for moving said instep counter into said position for exerting a force on the user's foot; and a retention member disposed on said adjustment assembly for retaining said instep counter in said position for exerting a force on the user's foot.

In another aspect the invention provides a footwear device comprising:

a rigid base for supporting the foot of a user thereon;

an instep counter for engaging the dorsum of the users foot;

an arm assembly operatively connecting said instep counter to said base of said footwear device to rigidly support said instep counter in a position for exerting a force on the user's foot, said arm assembly including a rigid arm and an arm base, said rigid arm having a first portion that is connected to said instep counter, a second portion that is adjustably connected to said arm base and a third portion that is pivotally connected to a forefoot support structure for said footwear device, said second portion and said third portion being offset transversely relative to each other on opposing ends of said rigid arm, said arm base being rigidly connected to said base of said footwear device;

an adjustment assembly located on said arm assembly for moving said instep counter into said position for exerting a force on the user's foot; and a retention member located on said adjustment assembly for retaining said instep counter in said position for exerting a force on the user's foot.

In another aspect the invention provides a footwear device comprising:

a rigid base for supporting the foot of a user thereon;

a heel counter on the rigid base for contact with the foot of a user in a first area of the foot posterior to the posterior aspect of the heel of the foot;

a medial forefoot counter for contact with the foot of a user in a second area of the foot medial to the medial aspect of the head of the first metatarsal of the foot;

a forefoot/midfoot compression member including an instep counter for engaging the dorsum of a user's foot and an arm assembly operatively connecting said instep counter to said rigid base of said footwear device to rigidly support said instep counter in a position for exerting a force on the user's foot, said arm assembly being disposed along only one of the medial or lateral aspects of said footwear device, wherein said arm assembly comprises a rigid arm and an arm base, said rigid arm having a first portion that is connected to said instep counter and a second portion that is adjustably connected to said arm base, said arm base being rigidly connected to said base of said footwear device;

an adjustment assembly located on said arm assembly for moving said instep counter into said position for exerting a force on the user's foot; and a retention member disposed on said adjustment assembly for retaining said instep counter in said position for exerting a force on the user's foot.

DETAILED DESCRIPTION OF THE INVENTION

The disclosures of U.S. Pat. Nos. 5,265,350 and 5,459,949 are incorporated herein by reference. These patents describe in detail the structure and function of the elements for a fit and support system for the foot. Reference should he made in particular to the description of the forefoot/midfoot compression member including the instep counter.

Figure 1:
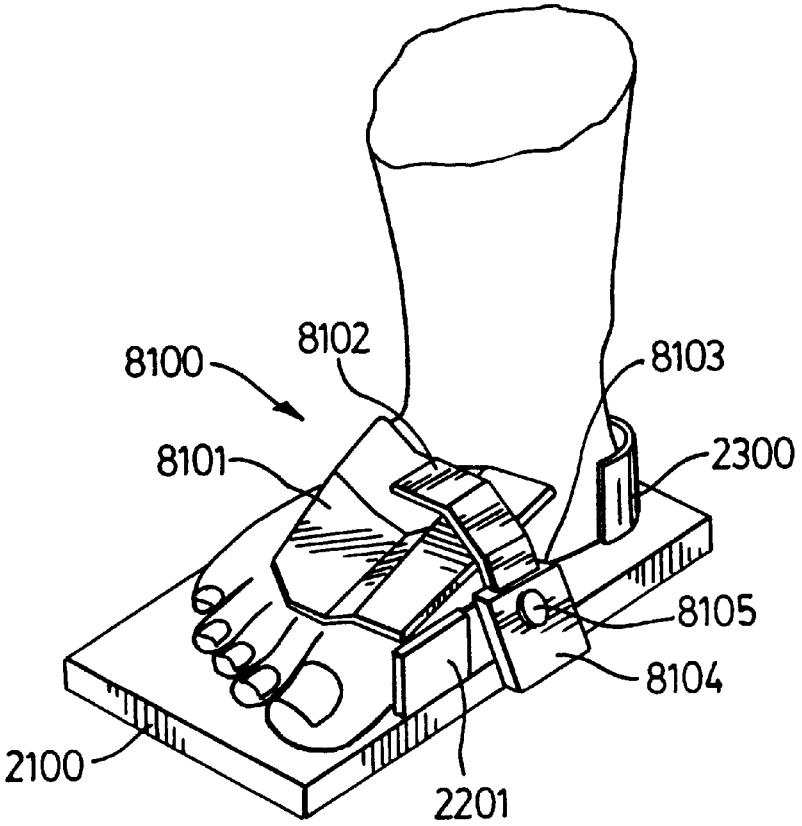
FIG. 1 is an isometric view of a compression member in accordance with the present invention with a linear adjustment arm.

FIG. 1 shows an isometric view of a fit and support system for a footwear device in accordance with the invention. A rigid base is shown at 2100 with a heel counter shown at 2300 and a medial forefoot counter at 2201. A forefoot/midfoot compression member is generally shown at 8100 with instep counter 8101 pivotally mounted to a rigid arm 8102. Rigid arm 8102 inserts into a receiving channel 8103 in arm base 8104 which is mounted to rigid base 2100. A retaining means for fixing the position of arm 8102 in arm base 8104 is shown at 8105.

It is important that the instep counter is rigidly supported in its desired position for exerting a downwardly and rearwardly directed force on the dorsum of a user's foot. In this way the significant forces generated by the user's lower limb during use of the footwear device in a sports activity may be harnessed and directed efficiently to the sports implement according to the technology disclosed in the prior referenced patents. It has been found that a rigid arm 8102 formed of Aluminum 7000 that is three millimeters thick is appropriate. Alternate materials such as carbon fibre composites or plastics such as glass-filled Nylon 6 might also be appropriate but this has yet to be verified.

It should also be appreciated that the arm base 8104 may be connected at one of either the medial or lateral aspects of the rigid base 2100. Furthermore, the rigid arm 8102 and arm base 8104 are sufficiently spaced from the user's foot to avoid interference with the natural changes in structure of the foot as it moves between a monopedal and a bipedal stance.

Figure 2:
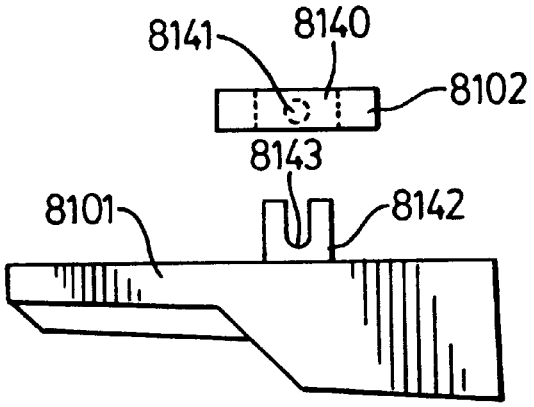
FIG. 2 is medial view of the instep counter pivot means.

The pivotal connection of instep counter 8101 to rigid arm 8102 is made with known methods. FIG. 2 shows a medial elevation of instep counter 8102 with a section of rigid arm 8102 showing a rectangular opening 8140 with pivot pin 8141. Pivot mount 8142 is shown mounted to instep counter 8101. Pivot mount 8142 is a rectangular block of material with a slot 8143 machined to receive pivot pin 8141. The top of the slot 8143 should be an interference fit with pivot pin 8141 so that when instep counter 8101 is pressed into place on pivot pin 8141 of pivot mount 8142 instep counter 8101 will be captured on arm 8102.

Figure 3:
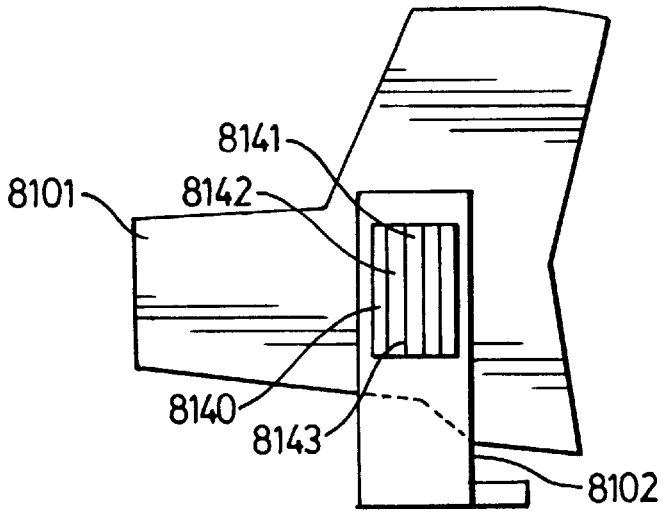
FIG. 3 is a plan view of the instep counter pivot means.

FIG. 3 shows a plan view of the pivot means described in FIG. 2 with instep counter 8101 mounted on the pivot means of arm 8102.

Figure 4:
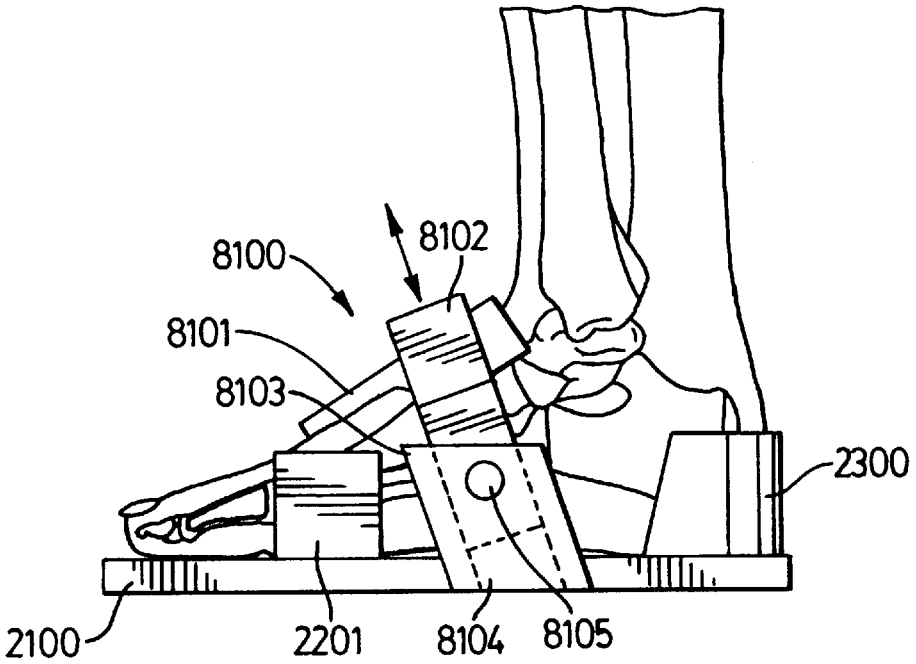
FIG. 4 is a medial view of the compression member as shown in FIG. 1.

FIG. 4 shows a medial elevation of the invention shown in FIG. 1. The rigid arm 8102 can telescope in and out of the channel 8103 in arm base 8104 in the directions indicated by the arrow. Known retaining means can be employed to fix the position of rigid arm 8102 in arm base 8104 when the instep counter is positioned on the user's foot. In this embodiment the retaining means is in the form of a clamping screw 8105 which threads through the vertical wall of arm base 8104 and applies force to the portion of arm 8102 within channel 8103.

Figure 5:
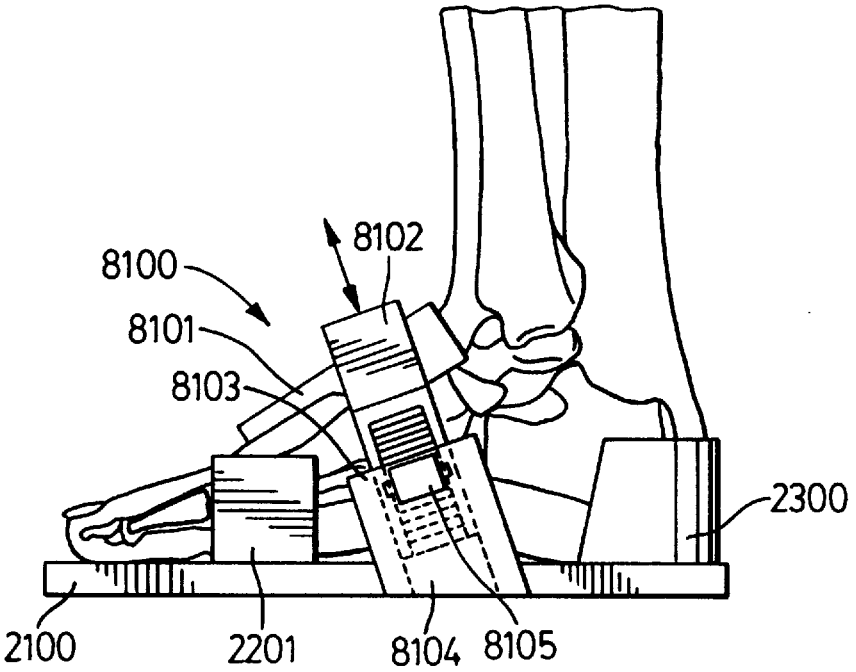
FIG. 5 is a medial view of the compression member of FIG. 1 showing a ratchet mechanism.

FIG. 5 shows substantially the same view as FIG. 4 except that retaining means 8105 is in the form of a ratchet mechanism. Arm 8102 has raked back teeth 8106 that engage with ratchet detent 8107. The teeth are configured to allow arm 8102 to move downward towards rigid base 2100 against ratchet detent 8107. Upward movement away from rigid base 2100 is prevented unless ratchet detent 8107 is disengaged.

Figure 6:
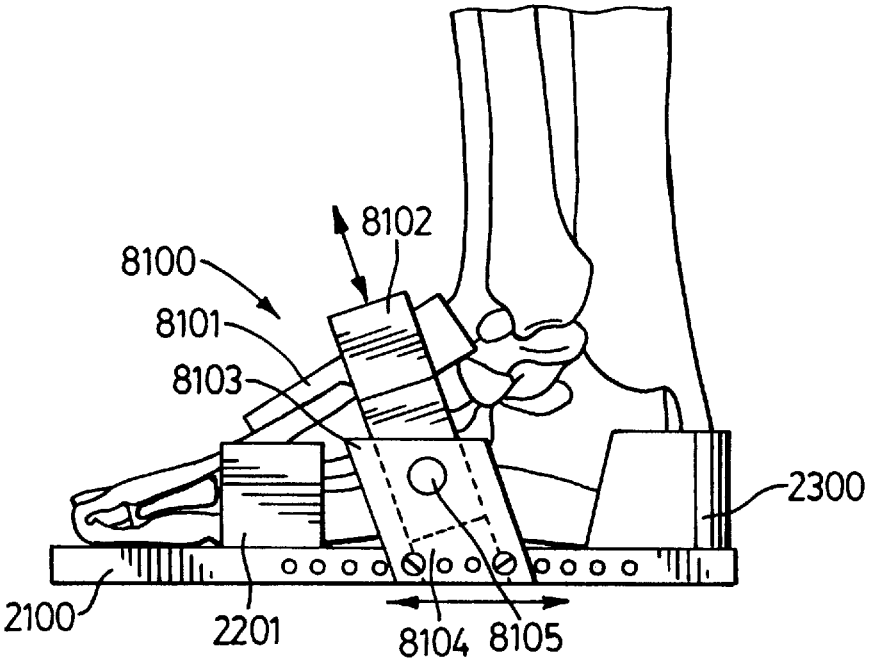
FIG. 6 is a medial view of the compression member of FIG. 1 showing antero-posterior adjustment means.

FIG. 6 shows the same view as FIG. 4 except that arm base 8104 is affixed to rigid base 2100 by two screws. Additional holes shown at 8109 permit the position of the arm base to be adjusted anteriorly or posteriorly as indicated by the arrows. This adjustment means permits the position of the instep counter 8101 to be adjusted antero-posteriorly in relation to rigid base 2100. This adjustment has the effect of permitting instep counter 8101 to be aligned antero-posteriorly on the foot of the user.

Figure 7:
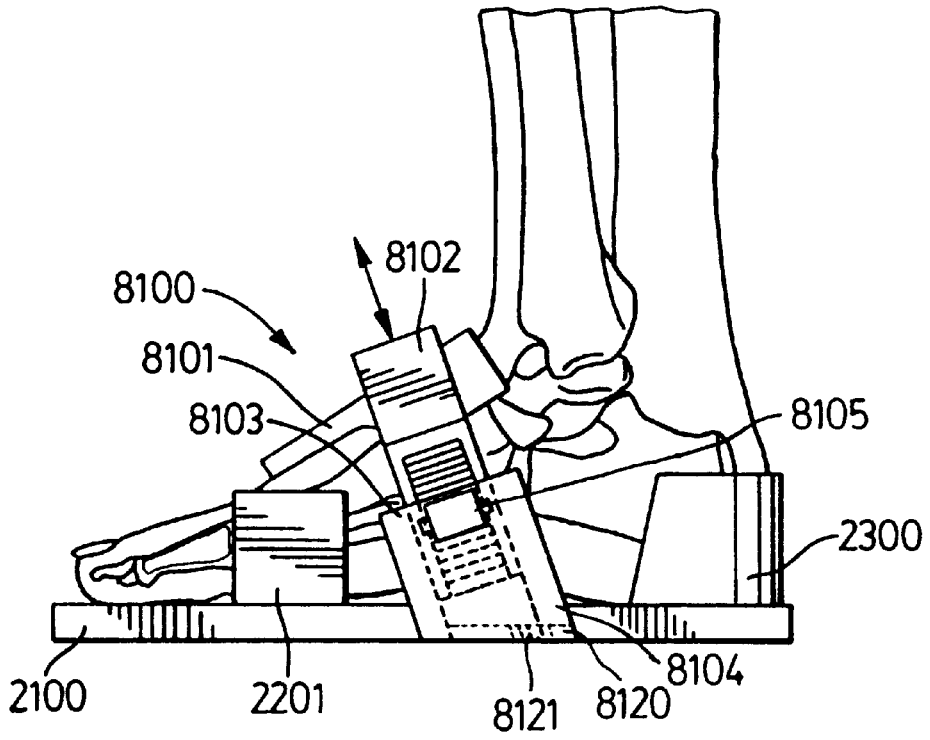
FIG. 7 is a medial view of the compression member of FIG. 1 showing medio-lateral adjustment means.

FIG. 7 shows substantially the same view of the invention as shown in FIGS. 1 and 4 except that rigid base 2100 has a relief 8120 to receive a horizontal component 8121 of arm base 8104.

Figure 8:
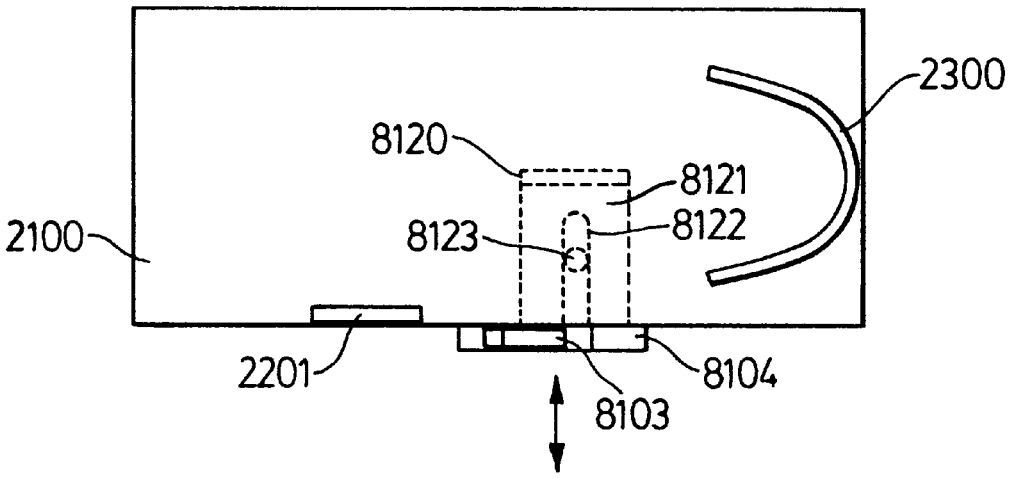
FIG. 8 is a plan view of the compression member of FIG. 1 showing the adjustment means in FIG. 7.

FIG. 8 is a plan view of the invention as shown in FIG. 7 with arm 8102 removed for the sake of clarity. A dashed rectangle 8120 defines the relief on the underside of rigid base 2100 intended to receive the horizontal component 8121 of arm base 8104. A tapered slot 8122 in the horizontal component 8121 allows arm base 8104 to be adjusted medio-laterally on rigid base 2100 as indicated by the arrow by loosening the machine fixing screw 8123. This adjustment permits the position of instep counter 8101 to be adjusted medio-laterally to the user's foot. Tensioning fixing screw 8123 against the horizontal component 8121 or arm base 8104 fixes the position of arm base 8104.

Figure 9:
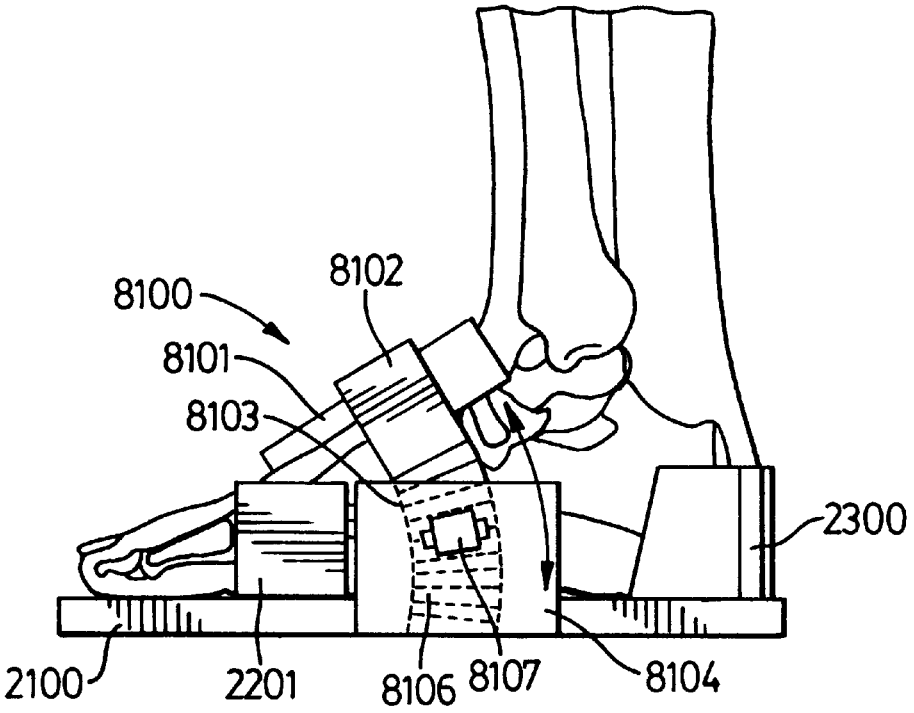
FIG. 9 is a medial view of the compression member of FIG. 1 showing a curved arm.

FIG. 9 shows a similar structure to that shown FIGS. 1 and 4 except that in this embodiment the arm 8102 is curved. The advantage of a curved arm is that the instep counter has a greater component of forward movement in relation to upward movement to that of a linear arm. Thus, when the instep counter is disengaged from the user's foot by releasing the arm retention mechanism it moves forward enabling greater ease of entry and exit from the footwear.

Figure 10:
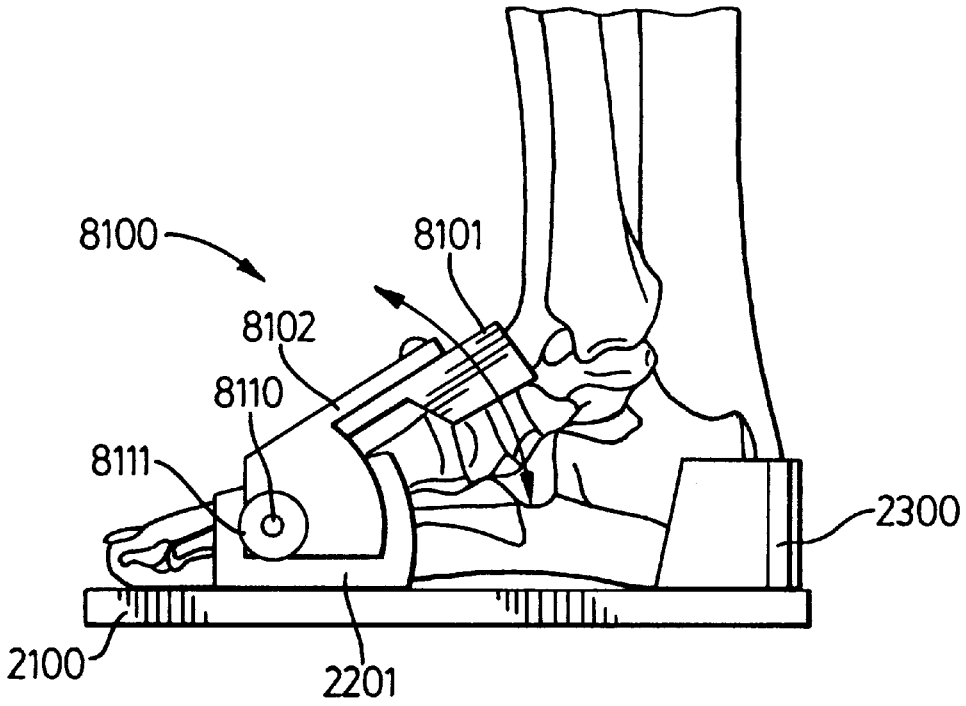
FIG. 10 is a medial view of the compression member of FIG. 1 showing an arm rotatable about a forefoot counter.

FIG. 10 shows a medial elevation of an alternative embodiment of the invention. In this embodiment arm 8102 is pivotally mounted to medial forefoot counter 2201 so as to be rotatable about medial forefoot counter 2201 in the direction shown by the arrows. It will be understood that the arm 8102 could alternatively be pivotally mounted to alternate support structures on the medial or lateral aspects of the footwear device. Axis 8110 is mounted on medial forefoot counter 2201 and extends as a stud with a threaded end to receive clamping knob 8111. Arm 8102 has a hole which receives axis stud 8110. Clamping knob 8111 threads onto axis stud 8110 and is tensioned over arm 8102 to lock its position on medial forefoot counter 2201 when instep counter 8101 is positioned against the foot of the user.

Figure 11:
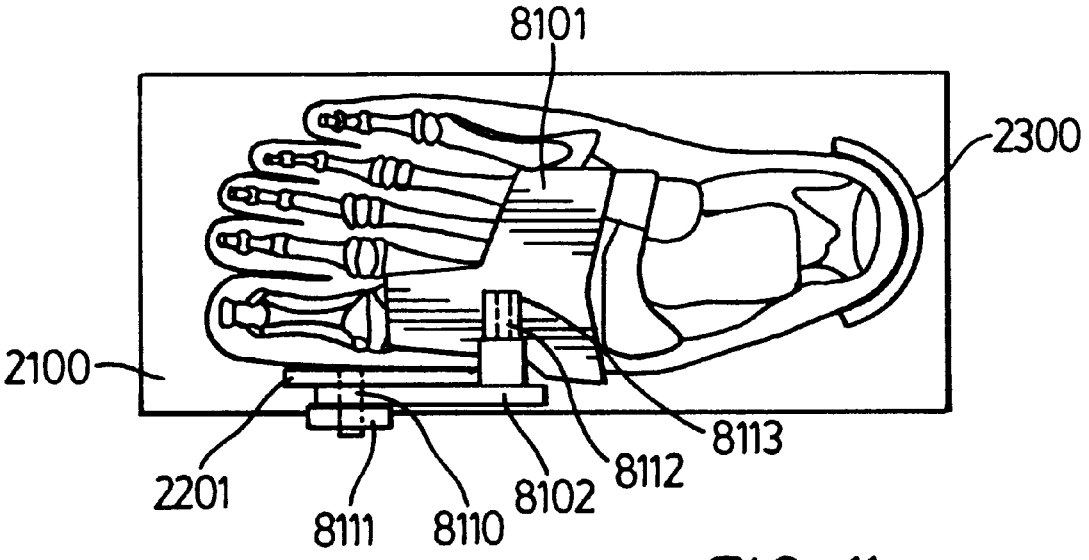
FIG. 11 is a plan view of the compression member shown in FIG. 10.

FIG. 11 shows a plan view of the embodiment illustrated in FIG. 10. Axis pin 8112 extends from arm 8102 through instep counter pivot 8113 to pivotally connect instep counter 8101 to arm 8102.

Figure 12:
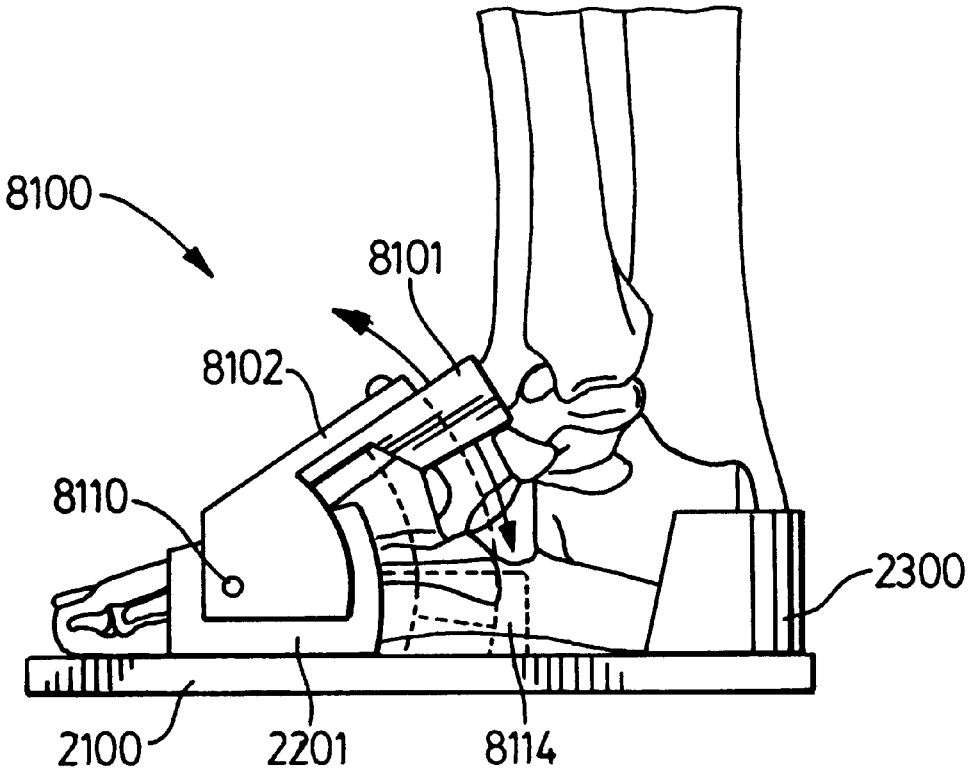
FIG. 12 is a medial view of the compression member of FIG. 10 showing two connection points with the rigid base.

FIG. 12 shows a medial elevation of a structure similar to that shown in FIG. 10 but with arm 8102 extending across the transverse aspect of rigid base 2100 to engage with an arm base 8114.

Figure 13:
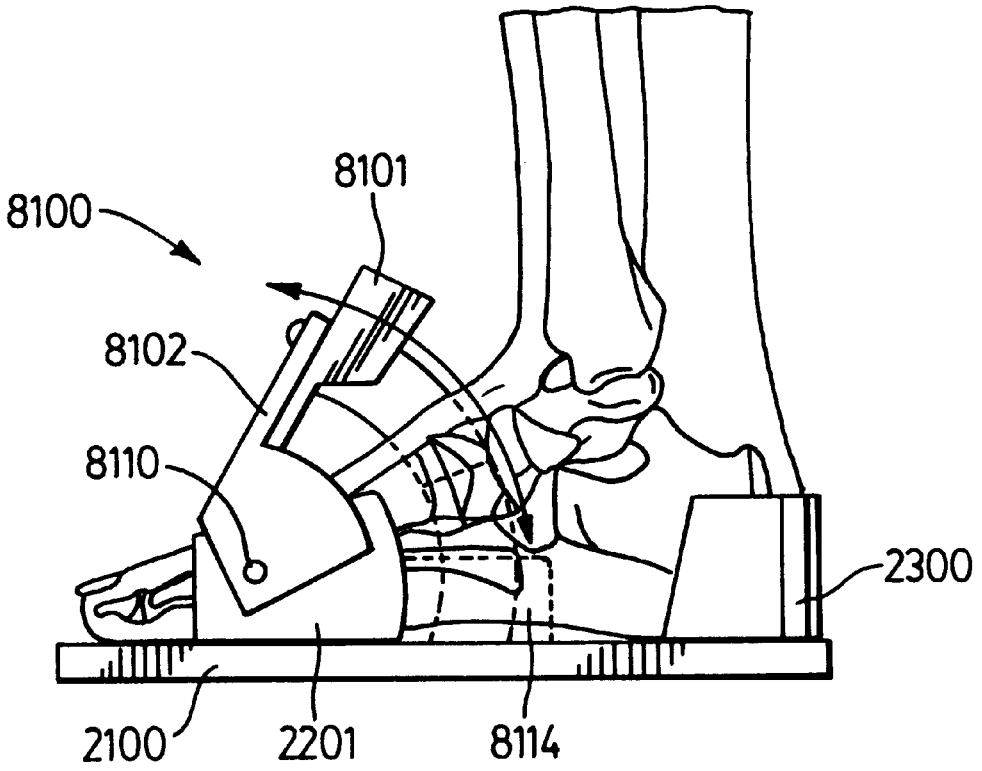
FIG. 13 is a medial view of the compression member of FIG. 12 showing the arm of the compression member in the open position.

FIG. 13 shows a medial elevation of the embodiment in FIG. 12 with arm 8102 rotated into the open position to permit ingress of the user's foot into the invention.

Figure 14:
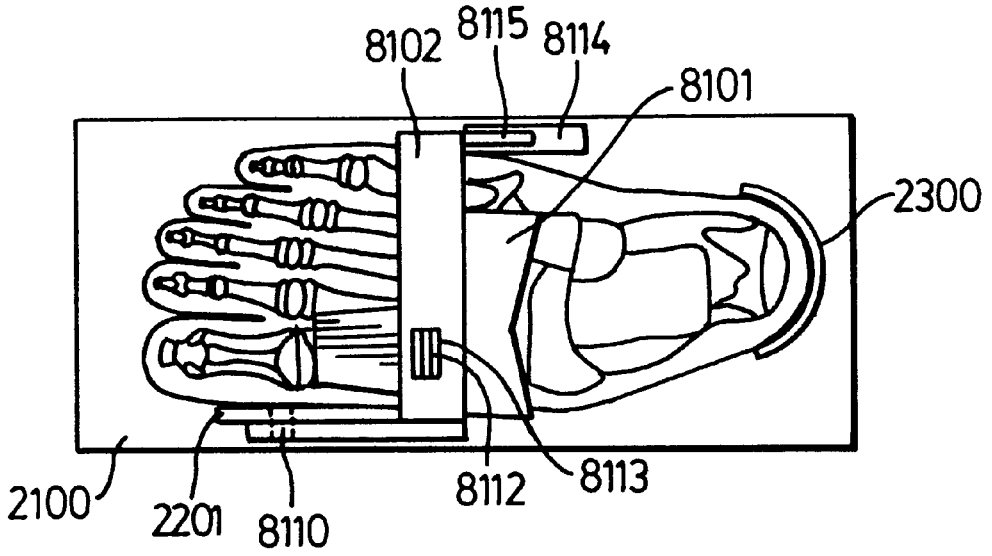
FIG. 14 is a plan view of the invention shown in FIG. 12.

FIG. 14 shows a plan view of the embodiment shown in FIG. 10. Arm 8102 inserts into a channel 8115 in arm base 8114 and its position is fixed with retaining means similar to those shown in FIGS. 4 and 5.

Figure 15:
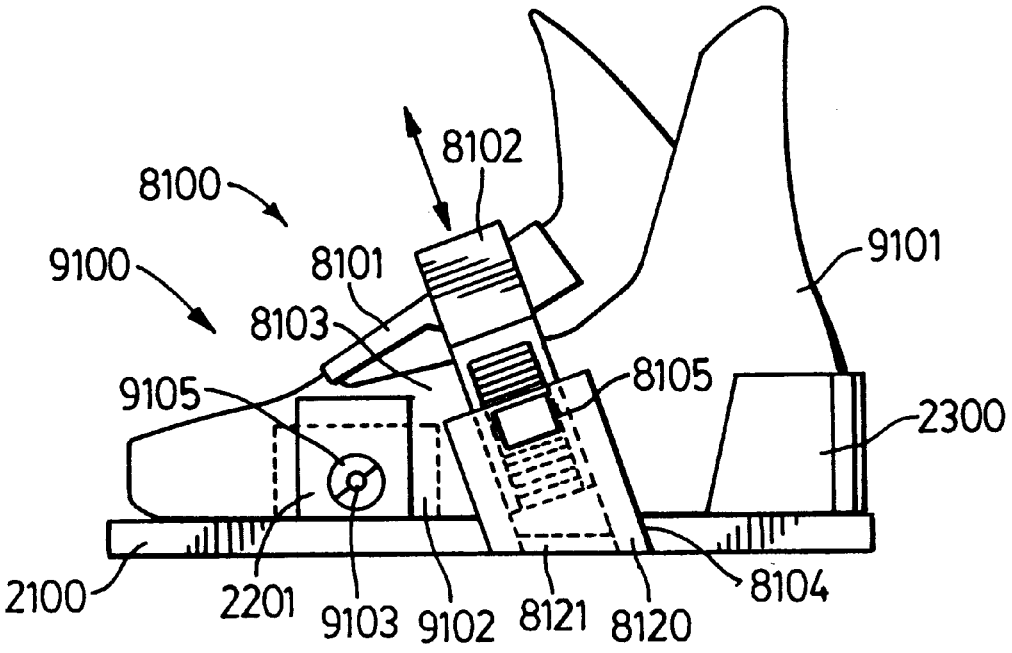
FIG. 15 is a medial view of a liner retention member in accordance with the present invention.

FIG. 15 shows a medial elevation of the dynamic fit and support system with a liner retention system generally shown at 9100. Liner 9101 is positioned on rigid base 2100. A liner retention plate 9102 resides within the interior of the exterior membrane of liner 9101. An internally threaded T-nut extension post 9103 of liner retention plate 9102 protrudes through the exterior surface of liner 9101 and inserts through a hole 9104 in medial forefoot counter 2201 or any other appropriate support wall on the footwear device. Fastener 9105 has a threaded element 9106 which inserts into the internal threads in T-nut extension post 9103 and when tensioned against liner retention plate 9102 secures liner 9101 to medial forefoot counter 2201 thus securing the medial position of liner 9101 in the absence of retention forces applied by instep counter 8101.

Figure 16:
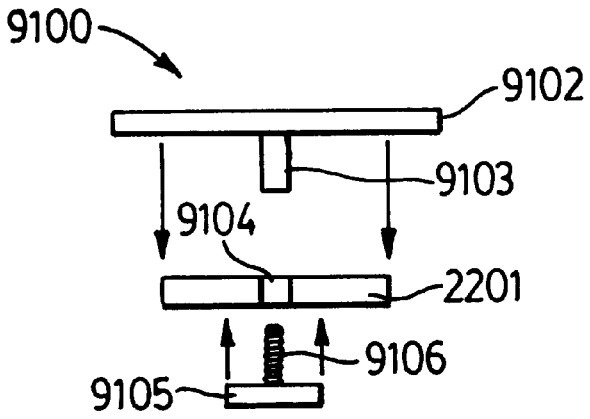
FIG. 16 is an exploded plan view of the elements of the retention member shown in FIG. 15.

FIG. 16 shows an enlarged exploded view of liner retention system 9100 in plan view. Arrows indicate the insertion of T-nut extension post 9103 of liner retention plate 9102 through liner 9101 [not shown] and through the hole 9104 in medial forefoot counter 2201 and the engagement of the threads of element 9106 of fastener 9105 into the internal threads of T-nut extension post 9103.

Figure 17:
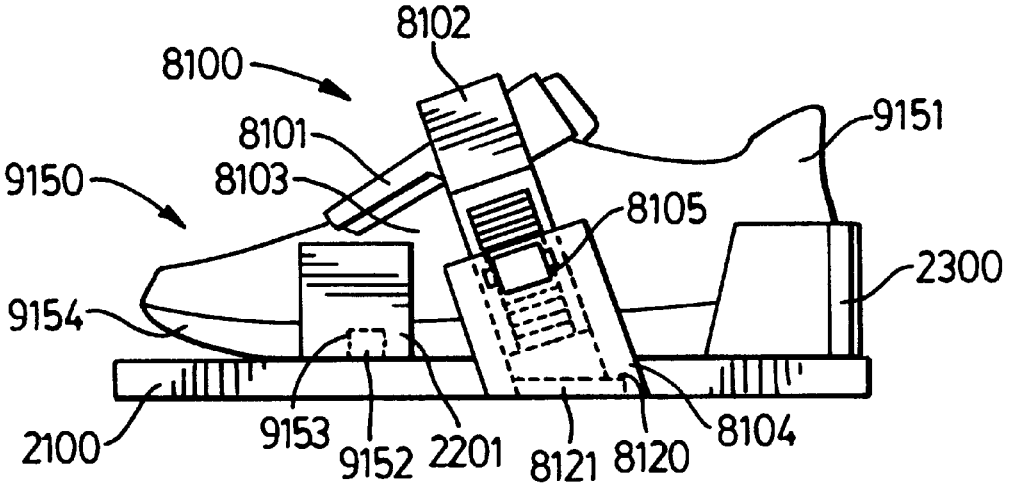
FIG. 17 is a medial view of a footwear retention member in accordance with the present invention.

FIG. 17 shows a medial elevation of the footwear device with a shoe alignment system generally shown at 9150. A shoe 9151 is positioned on rigid base 2100 with the heel of the shoe positioned against heel counter 2300. An alignment lug 9152 is affixed to rigid base 2100 and extends vertically into a mating receiving profile 9153 molded into the sole 9154 of running shoe 9151. Thus, when the receiving profile 9153 is positioned over alignment lug 9152 and instep counter 8101 is exerting a downward force on the foot of a user inserted in shoe 9151 the medio-lateral position of shoe 9151 on rigid base 2100 is fixed and lateral movement of shoe 9151 on rigid base 2100 is prevented.

Figure 18:
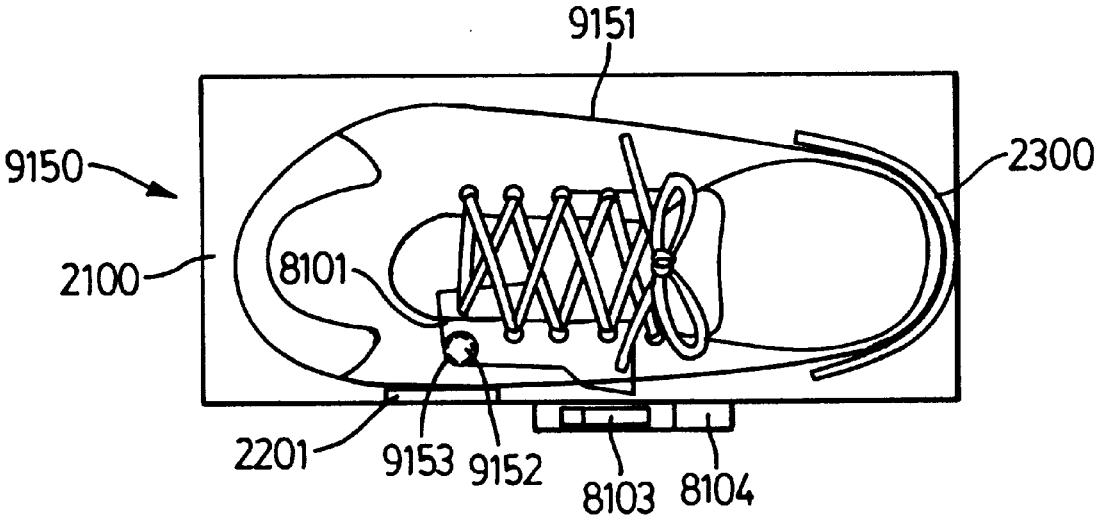
FIG. 18 is a plan view of the retention member shown in FIG. 17.

FIG. 18 is a plan view of shoe alignment system 9150 showing the elements of the system and the preferred location of alignment lug 9152 on rigid base 2100 in relation to instep counter 8101. Arm 8102 is not shown for the sake of clarity. Alignment lug 9152 is located on rigid base 2100 so as to be substantially under the ball of the foot of the user and below the anterior aspect of instep counter 8101 so that the compressive force exerted on the shoe and foot of the user prevents the sole 9154 of shoe 9151 in the vicinity of lug 9152 from moving vertically off rigid base 2100. The outline of instep counter 8101 is shown for reference. Thus, when instep counter 8101 is engaged with the user's foot by the operation of the forefoot/midfoot compression member the medio-lateral position of shoe 9151 is fixed on rigid base 2100.

It is to be understood that what has been described is a preferred embodiment to the invention. If the invention nonetheless is susceptible to certain changes and alternative embodiments fully comprehended by the spirit of the invention as described above, and the scope of the claims set out below.

We claim:

1. A footwear device comprising:

a rigid base for supporting the foot of a user thereon;

an instep counter for engaging the dorsum of the user's foot;

an arm assembly operatively connecting said instep counter to said base of said footwear device to rigidly support said instep counter in a position for exerting a force on the user's foot, said arm assembly being disposed along only one of the medial or lateral aspects of said footwear device, wherein said arm assembly comprises a rigid arm and an arm base, said rigid arm having a first portion that is connected to said instep counter and a second portion that is adjustably connected to said arm base, said arm base being rigidly connected to said base of said footwear device;

an adjustment assembly located on said arm assembly for moving said instep counter into said position for exerting a force on the user's foot; and a retention member disposed on said adjustment assembly for retaining said instep counter in said position for exerting a force on the user's foot.

2. A footwear device as claimed in claim 1, further comprising a footwear retention member having:

an alignment lug protruding generally vertically from a base for said footwear device, said lug being sized to mate with a corresponding profile defined in the sole of an article of footwear.

3. A footwear device as claimed in claim 1, further comprising a liner retention member having:

a retention plate sized to fit between an interior membrane and an exterior membrane of a liner for a user's foot;

a post connected to said retention plate and sized to protrude through an opening defined in said exterior membrane of said liner;

a bore defined in a wall of said footwear device for receiving said post; and a fastener adapted to engage said post on an opposing side of said wall to secure said liner to said footwear device.

4. A forefoot/midfoot compression member as claimed in claim 3, wherein said bore is defined through a medial forefoot counter for said footwear device.

5. A footwear device as claimed in claim 1, wherein said rigid arm is pivotally connected at one end to a forefoot support structure for said footwear device.

6. A footwear device as claimed in claim 5, wherein said adjustment assembly comprises means for tensioning the pivotal connection between said rigid arm and said forefoot support structure to prevent relative pivotal movement during use.

7. A footwear device as claimed in claim 1, wherein at least said second portion of said rigid arm is curved.

8. A footwear device member as claimed in claim 1, wherein a relief is defined in said base of said footwear device to receive a horizontal component of said arm base.

9. A footwear device as claimed in claim 8, wherein means are defined in said horizontal component to facilitate medial-lateral adjustment of said arm base relative to said base for said footwear device.

10. A footwear device as claimed in claim 1, wherein means are located on said base of said footwear device for adjusting the position of said arm base anteriorly or posteriorly relative to said footwear device.

11. A footwear device as claimed in claim 10, wherein said arm base adjustment means comprises a tensioning screw adapted to be received in a corresponding slot defined in a horizontal component of said arm base for adjusting the position of said arm base relative to said footwear device.

12. A footwear device as claimed in claim 1, wherein said adjustment assembly comprises a ratchet detent located on said arm base and a plurality of corresponding teeth defined on said second portion of said rigid arm, said ratchet detent engaging said teeth to prevent upward movement of said rigid arm relative to said base for said footwear device.

13. A footwear device as claimed in claim 1, wherein said retention member comprises a threaded fastener extending through said arm base to clamp said second portion of said rigid arm in said channel.

14. A footwear device as claimed in claim 1, wherein said arm base defines a channel for slidably receiving said second portion of said rigid arm.

15. A footwear device as claimed in claim 1, wherein said arm assembly is vertically adjustable using said adjustment assembly.

16. A footwear device compression member as claimed in claim 1, wherein said instep counter is pivotally connected to said arm assembly.

17. A footwear device compression member as claimed in claim 16, wherein said instep counter pivots about a transverse axis extending between the medial and lateral aspects of said footwear device.

18. A footwear device comprising:

a rigid base for supporting the foot of a user thereon;

an instep counter for engaging the dorsum of the user's foot;

an arm assembly operatively connecting said instep counter to said base of said footwear device to rigidly support said instep counter in a position for exerting a force on the user's foot, said arm assembly including a rigid arm and an arm base, said rigid arm having a first portion that is connected to said instep counter, a second portion that is adjustably connected to said arm base and a third portion that is pivotally connected to a forefoot support structure for said footwear device, said second portion and said third portion being offset transversely relative to each other on opposing ends of said rigid arm, said arm base being rigidly connected to said base of said footwear device;

an adjustment assembly located on said arm assembly for moving said instep counter into said position for exerting a force on the user's foot; and a retention member located on said adjustment assembly for retaining said instep counter In said position for exerting a force on the user's foot.

19. A footwear device as claimed in claim 18, wherein said arm base is located on a lateral aspect of said footwear device.

20. A footwear device comprising:

a rigid base for supporting the foot of a user thereon;

a heel counter on the rigid base for contact with the foot of a user in a first area of the foot posterior to the posterior aspect of the heel of the foot;

a medial forefoot counter for contact with the foot of a user in a second area of the foot medial to the medial aspect of the head of the first metatarsal of the foot;

a forefoot/midfoot compression member including an instep counter for engaging the dorsum of a user's foot and an arm assembly operatively connecting said instep counter to said rigid base of said footwear device to rigidly support said instep counter in a position for exerting a force on the user's foot, said arm assembly being disposed along only one of the medial or lateral aspects of said footwear device, wherein said arm assembly comprises a rigid arm and an arm base, said rigid arm having a first portion that is connected to said instep counter and a second portion that is adjustably connected to said arm base, said arm base being rigidly connected to said base of said footwear device;

an adjustment assembly located on said arm assembly for moving said instep counter into said position for exerting a force on the user's foot; and a retention member disposed on said adjustment assembly for retaining said instep counter in said position for exerting a force on the user's foot.

* * * * *